United States Patent [19]

Desrochers et al.

[11] Patent Number: 4,588,036

[45] Date of Patent: May 13, 1986

[54] CONTINUOUS, UNDISTURBED SAMPLING BY ROTATIONAL BORING IN NON-PLASTIC GRANULAR TILLS

[75] Inventors: Gérard Desrochers, Ville Mercier; Louis Dubreuil, Montréal; Joseph Grumich, St-Lambert, all of Canada

[73] Assignee: Hydro-Quebec, Quebec, Canada

[21] Appl. No.: 534,714

[22] Filed: Sep. 22, 1983

[51] Int. Cl.[4] ..... E21B 25/00

[52] U.S. Cl. ..... 175/58; 175/244; 175/247

[58] Field of Search ..... 175/58, 59, 60, 66, 175/206, 244, 246, 247, 209

[56] References Cited

U.S. PATENT DOCUMENTS

| | | | |
|---|---|---|---|
| 2,145,170 | 1/1939 | Frenzel | 175/60 |
| 2,277,989 | 3/1942 | Kinnear | 175/60 |
| 2,365,858 | 12/1944 | Binkley | 175/209 X |
| 3,323,604 | 6/1967 | Henderson | 175/58 X |
| 3,338,322 | 8/1967 | Henderson | 175/60 X |
| 3,399,739 | 9/1968 | Goodwin | 175/66 X |
| 3,424,255 | 1/1969 | Mori | 175/60 |
| 3,481,412 | 2/1969 | Rowley | 175/247 |
| 3,874,464 | 4/1975 | Sweeney | 175/58 |

FOREIGN PATENT DOCUMENTS

| | | |
|---|---|---|
| 564408 | 2/1979 | U.S.S.R. . |
| 804684 | 2/1981 | U.S.S.R. . |

*Primary Examiner*—Stephen J. Novosad
*Assistant Examiner*—William P. Neuder
*Attorney, Agent, or Firm*—Oblon, Fisher, Spivak, McClelland & Maier

[57] ABSTRACT

An apparatus and a method to obtain continuous undisturbed sampling, by rotational boring in non-plastic granular tills. The designation of non-plastic granular till refers to a heterogeneous glacial deposit containing an unstratified and unsorted mixture of silt, sand, gravel, cobbles and boulders with no clay particles. In the geotechnical terminology, this material is generally classified as a gravely silty sand with variable percentage of cobbles and boulders (the non-cohesive matrix consisting of silt and sand). The apparatus comprises a string of drill rods having a core barrel and a new designed coring bit of preselected diameter secured at an end thereof. A drive rotates the drill rod at a predetermined rpm, dependent on the coring bit diameter, to impart rotation to the coring bit to penetrate the core barrel in the soil at a predetermined rate. The coring bit has a crown shaped drilling head having a plurality of fluid convection channels therein. A mud drill fluid is convected under pressure over the drilling head through the passages and then into an outer circulation annulus outside of the coring bit not to disturb the granular till sample. The mud has a very high viscosity of at least 70 seconds as measured on a Marsh funnel and the flow rate is kept at a predetermined low value. An inner barrel is suspended in the core barrel and dimensioned for receiving therein the undisturbed sample of soil. Sample recovery is achieved by retrieving the core barrel inner tube by means of a wire line system and by reversing the circulation of the mud flow.

17 Claims, 3 Drawing Figures

CONTINUOUS, UNDISTURBED SAMPLING BY ROTATIONAL BORING IN NON-PLASTIC GRANULAR TILLS

BACKGROUND OF INVENTION (a) Field of the Invention

The present invention relates to an apparatus and a method to obtain continuous undisturbed sampling, and particularly, but not exclusively, from a heterogeneous granular till soil.

(b) Description of the Prior Art

Sampling non-plastic granular till has always proven to be a problem as precise sampling thereof has never been adequate. Many geotechnical problems are connected with the construction of earth dams, highways, buildings, or other structures in or on such type soils. It is known in the art that granular basal till is an excellent foundation stratum and also an excellent construction material often used in the construction of dam cores (if the percentage of silt is over 15%). The difficulty in obtaining samples of granular till is due to its heterogeneous granular composition of silt, sand, gravel, and stones of all sizes with non-plastic characteristic. In order to satisfactorily determine the geological and geotechnical characteristics of such soil deposits, it is essential to obtain sampling with as high recovery as possible.

The common method used to sample such soil is known as the SPT (Standard Penetration Test). The method consists in driving a casing by percussion or rotation into the soil while utilizing water as a fluid to permit the displacement of particles in the area of advancement of said casing. At predetermined depths, usually 1.5 meters, a thick-walled split-spoon sampler is driven below the casing to take a sample. This method has not been found satisfactory as the sample is disturbed and the recovery is very low, thus giving false information as to the exact nature of the soil composition. The presence of cobbles and boulders and the density of the granular till make it very difficult and often impossible to drive the sampler into the ground. Still further, the utilization of water as a drilling fluid washes away the fine particles (silt and sand) present in this soil and thus disturbs and modifies the composition of the soil at the bottom of the casing (sampling depth). In conclusion, this method has not been found adequate. The information obtained is very difficult and often impossible to interpret.

Other techniques of sampling such heterogeneous granular till have been tried but have thus far proven unsuccessful and very costly. For example, the granular till composition can be determined by excavating trenches therein. The disadvantage of such method is that the excavating equipment is limited in depth. Further, because of the large size of such equipment, they often cannot be brought to the site where the excavation is required. Seismic techniques have also been tried to obtain some definition of the lithology of the granular till. However, such techniques also cannot give a precise enough geotechnical information of the formation of the granular till.

No one has heretofore been able to obtain an undisturbed continuous sampling of non-plastic granular till soil.

SUMMARY OF INVENTION

It is a feature of the present invention to provide an apparatus and a method to obtain continuous undisturbed sampling and specifically, but not exclusively, from a heterogeneous granular till soil, which substantially overcomes the above disadvantages of the prior art.

Another feature of the present invention is to provide an apparatus and a method to obtain continuous, undisturbed sampling from granular till by inserting a casing into the ground and extracting a core sample from within the casing without disturbing the formation of the composition of the soil in the core.

Another feature of the present invention is to provide an apparatus and a method to obtain continuous, undisturbed sampling from granular till which apparatus and method is substantially more economical than that heretofore utilized.

Another feature of the present invention is to provide an apparatus and a method to obtain continuous, undisturbed sampling from granular till and wherein the core samples are of superior quality and undisturbed thereby requiring less sample bore holes to be made.

Another feature of the present invention is to provide an apparatus and a method to obtain continuous, undisturbed sampling from granular till and wherein a precise grain-size distribution of the till can be determined in its entire depth and the size of the borrow area occupied can be accurately determined thus making it possible to locate granular till deposits of required volumes such as is often necessary for the construction of dykes or dams (impervious core, etc.). The apparatus and method also make it possible to locate such required volumes of granular till deposits at the closest proximity to the area where such material is required thus resulting in a considerable cost saving in the transportation of the granular till.

Another feature of the present invention is to provide an apparatus and a method to obtain continuous, undisturbed sampling from granular till and wherein the drilling fluid utilized does not wash away the fine non-cohesive particles (silt and sand) present in such granular till.

Another feature of the present invention is to provide an apparatus and a method to obtain continuous and undisturbed sampling from granular till thus allowing precise geotechnical properties on such soil deposits as a foundation stratum for the design of earth dam or dykes, thus likely permitting such construction without costly excavation or foundation treatments (slurry trenches).

According to the above features, from a broad aspect, the present invention provides a new concept in drilling and sampling techniques. Particular boring apparatus diameter, rotational speeds, down pressure circulation flow and very high viscosity drilling fluids were researched and experimented with to properly obtain samples of non-plastic heterogeneous granular till material. Also, a new core bit has been designed to cope with the desired specifications. The core bit was adapted on a large triple tube wire line core barrel.

According to a broad aspect of the present invention there is provided a boring apparatus to obtain continuous, undisturbed sampling from heterogeneous granular till soils. The apparatus comprises a hollow drill rod having a coring bit of preselected diameter secured at a boring end thereof. Drive means is provided for rotating the drill rod at a predetermined speed and down pressure dependent on the coring bit diameter to impart rotation to the coring bit for the penetration of said drill rod in the soil at a predetermined rate. The coring bit has a drilling head. A plurality of fluid convection channels, of preselected diameter, are provided in the drilling head. Convection means provides a pressurized flow of a mud drill fluid in said hollow drill rod, at a predetermined flow rate, and convecting it over the drilling head by passage of said mud through the channels. An outer casing is positioned about the drill rod and spaced therefrom to form a mud circulation annulus through which mud is returned when the drill rod is rotated whereby mud flow is away from the sample casing bit. The mud has a viscosity of at least 70 seconds as measured with a Marsh funnel. A soil retractable sample receiving tube is suspended in the core barrel and dimensioned for receiving in close fit therein an undisturbed sample of the granular till soil and capable of being retracted from the drill rod without disburbing the sample.

According to another broad aspect of the present invention there is provided a method to obtain continuous undisturbed sampling from a heterogeneous granular till soil. The method comprises the steps of boring, at a predetermined speed and down pressure dependent on a preselected coring bit diameter, an annular cavity in a soil to be sampled by means of the in a soil to be sampled by means of the hollow drill rod having a coring bit with a crown drilling head at a boring end of the tube. Simultaneously, a mud drill fluid is injected, at a predetermined flow rate through a plurality of convection channels in the drill head so as to flow over the crown shaped drilling head exteriorly of the coring bit. The fluid has a viscosity of at least 70 seconds as measured with a Marsh funnel. The drill fluid is convected passed the drill head and into a circulating annulus formed between the drill rod and the outer casing spaced about the drill rod. A sample receiving tube is suspended in the coring bit, and is advanced at a predetermined rate simultaneously with the coring bit and receives in close fit therein a soil core sample excavated by the drilling head. Subsequently, the sample receiving tube is retracted from the hollow drill rod without disturbing the granular till sample therein.

The designation of non-plastic granular till refers to a heterogeneous glacial deposit containing an unstratified and unsorted mixture of silt, sand, gravel, cobbles and boulders with no clay particles. In the geotechnical terminology, this material is generally classified as a gravely silty sand with cobbles and boulders (the non-cohesive matrix consisting of silt and sand).

BRIEF DESCRIPTION OF DRAWINGS

A preferred embodiment of the present invention will now be described with reference to the example thereof as illustrated in the accompanying drawings in which:

FIG. 3 is an end view of the core bit.

DESCRIPTION OF PREFERRED EMBODIMENTS

Figure 1:
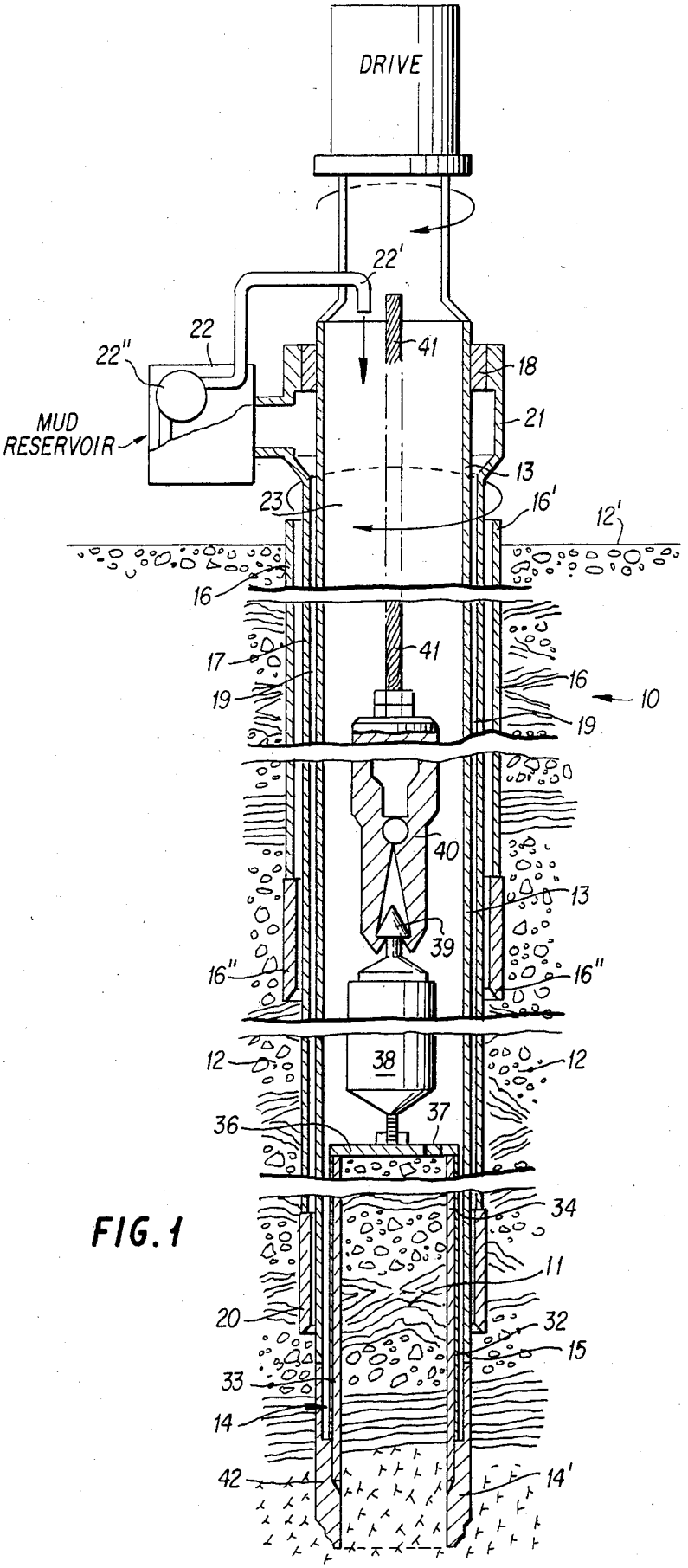
FIG. 1 is a cross-section view of the apparatus of the present invention.

Referring now to the drawings, and more particularly to FIG. 1, there is shown generally at 10 the boring apparatus of the present invention which is utilized to extract a soil core sample 11 from the soil 12, preferably, but not exclusively, a heterogeneous granular till soil. The apparatus comprises a string of hollow drill rods 13 having a core bit 14' secured at a lower boring end 15 thereof. A sample receiving means, herein an inner tube 34 of a core barrel 14 is retained inside the core bit 14'. The core barrel is of the triple tube wire line type, known in the art.

Prior to inserting the core barrel 14 into the ground surface 12', it is preferable to insert a soil stabilizing tube 16 into the soil and leaving an upper end 16' thereof extending over the soil surfaces 12' whereby to prevent the washing away of the soil about an outer casing 17. Such stabilizing tubes are well known in the art of bore drilling. The outer soil stabilizing tube 16 is provided with a casing shoe 16" at a lower end thereof and the tube is inserted in the soil by percussion or rotation thereof. This tube is usually inserted to a depth of approximately 2 meters and the soil therewithin is removed.

The outer casing 17 and drill rods 13 are driven into the ground within the stabilizing tube 16. A mud packing box 18 is secured at the upper end 21 of the casing 17. A mud circulation annulus 19 is defined by the space between the drill rods 13 and the outer casing 17. The lower end of the outer casing 17 is provided with a casing shoe 20.

As shown, the circulation annulus 19 leads to the funnel shaped part of the packing box 18 at the top end 21 of the casing 17 about the drill rods 13 whereby to return in the mud reservoir 22 the drilling fluid which is utilized in the boring and which transports fine particles. The mud is cleaned in the reservoir 22 and returned, by means of pump 22" and suitable convection means 22', to the inner area 23 of the drill rods 13 from the top thereof by mud circulating apparatus known in the art and not shown in detail in this drawing.

In order to obtain penetration of the boring apparatus into the soil, the drill rods 13 and outer casing 17 are rotated, alternatively, by a suitable drive well known in the art and not shown herein. However, for drilling in such soil it has been found that the rotational speeds should be kept at slow speeds of about 150 to 200 rpm. Also, for drilling in such soil, it has been found that drilling mud fluid should have a viscosity of at least 70 seconds as measured with a Marsh funnel and preferably this viscosity should be in the range of 80 to 90 seconds. This mud fluid circulates in the inner area 23 inside the drill rods 13, through the core barrel 14, in the gap 32 between the core barrel and its inner tube 34 through the channels 29 and the part holes 30 in the core bit 14' and the return flow is channelled via the circulation annulus 19 between the rods 13 and the casing 17.

Figure 3:
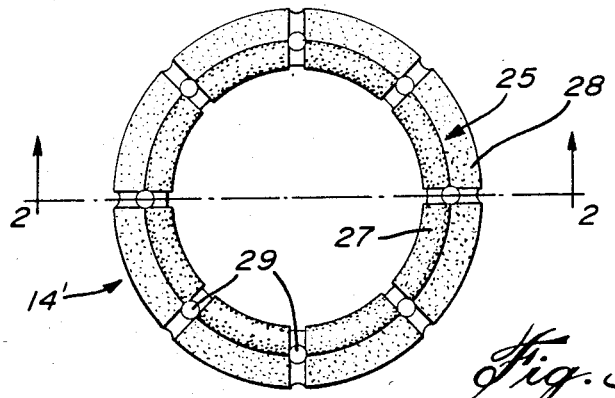
FIG. 3 is a cross-section view of the core bit as taken along cross-section lines A—A of FIG. 3.
Figure 2:
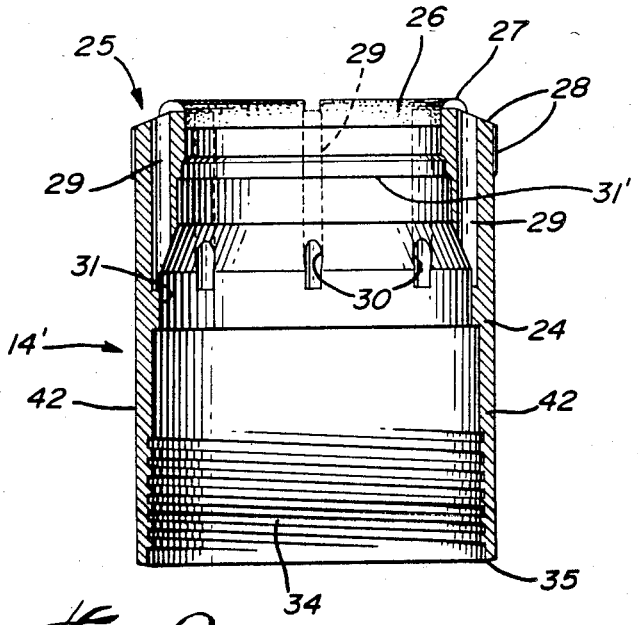

Referring to FIGS. 2 and 3, there is shown the construction of the core bit 14' which is connected at the lower end of the core barrel 14. The core bit 14' is constituted by a cylindrical body 24 having a crown shaped drilling head 25 formed at a boring end thereof. The crown shaped drilling head 25 is defined by an inner abrading ring 26 having a convexly curved outer abrading surface 27. An outer rearward tapered circumferential abrading surface 28 is provided on a slope face portion of the boring end of the bit 14' with both the abrading ring and the tapered abrading surface being constructed of solid core material having embedded industrial diamonds of a size of about 60 to 90 stones per carat.

As shown in FIGS. 2 and 3 a plurality of fluid channels 29, herein eight such channels, are equidistantly spaced about the crown shaped drilling head 25 whereby to convect the drilling mud over the drilling head. This outward flow of mud does not disturb the soil core which forms inwardly of the ring 26 as the drill head 25 penetrates the soil.

The coring bit 14′ is also provided with an inner thread portion 34 adjacent a connecting end 35 thereof to receive the lower end 14 of the drill rods 13 in threaded engagement therein. The diameter of the inner abrading ring 26 is such as to excavate a core sample which will fit precisely into the inner split tube 34 latched into the core barrel 14 and resting against a support edge 31′ in the core bit 14′.

As seen in FIG. 1, the core barrel 14 has a connecting top end constituted by a solid disc 36 having evacuating ports 37 provided therein for the evacuation of mud fluid from within the casing as the core sample rises therein. A connecting element 38 is secured to the cover 36 whereby to lock the inner tube during the drilling operation and to permit unlatching and withdrawal of the inner tube of the core barrel 14. A retraction cable is coupled to an engageable knob 39 at the top of the connecting element 38 by means of a gripping jaw device 40 secured to the end of the cable 41.

Sampling is carried out as the core bit 14′ is driven into the soil by rotation. The sample cut away from the soil enters the inner tube 34 as the core barrel advances by the pressure and rotation exerted on the drill rods. Mud circulating pressures are kept between 140 to 175 KPa. The mud is a bentonite mud pressurized to about from 140 to 175 KPa by the pump 22. As the bit excavates the material in its path, be it a large stone, sand or gravel, the mud is displaced from the crown head portion 25 over the outer wall 42 thereof, away from the core barrel, and through the circulation annulus 19 between the bore tube and the outer tubular member and back into the reservoir 22 where the fine particles convected thereby are separated by centrifugal spinning in a pump (not shown) as is known in the art. The mud having thus been cleaned is re-injected into the top end of the drill rods 13.

When the core barrel has attained a predetermined distance into the ground, the drilling operation is stopped and the inner tube 34 is pulled out of the hole slowly and delicately by the cable 41. In order to assist in the retraction of the core sample 11, the mud circulation is reversed whereby the mud is pumped from the reservoir 22, through the circulating annulus 19 and back into the bottom of the hole. This exerts an upward push onto the inner tube and the sample and eliminates the suction effect that would otherwise be causing by pulling the inner tube in a liquid mass. The speed of retraction of the inner tube is coordinated with the rate of flow of the injected mud through the circulation annulus 19. Thereafter, the outer casing 17 is rotated to lower it to the end of the core bit at the next sampling level.

Progression in drilling operations is then carried out by adding sections of casing and drill rods 13 to the next sampling depth, as is known in the art.

In a particular embodiment constructed, the drill rod 13 had a diameter of 139.7 mm and the speed of rotation of the rods varied between 150 to 200 rpm providing a penetration of about 2.5 to 4 cm per minute. The diameter of the port holes 30 in the coring bit 14′ are of a selected size of 6.5 mm for proper circulation of the high mud viscosity utilized and for the low circulating mud volume of 18 to 23 liters/min. The mud fluid pressure at the coring bit liquid was determined to be 27 KPa.

It is within the ambit of the present invention to provide any obvious modifications of the example of the preferred embodiment described herein, provided these modifications fall within the scope of the appended claims. For example, the apparatus is not exclusively limited for use in the sampling of granular till and may be used for the sampling of other types of granular soils.

We claim:

1. A boring apparatus to obtain continuous undisturbed sampling from heterogeneous non-cohesive granular till soils, said apparatus comprising a hollow drill rod having a coring bit of preselected diameter secured at a boring end thereof, drive means for rotating said drill rod at a predetermined speed and down pressure dependent on the coring bit diameter to impart rotation to said coring bit for the penetration of said drill rod in said soil at a predetermined rate, said coring bit having an annular drilling head, a plurality of fluid convection channels of preselected diameter in said annular drilling head, convection means to provide for a pressurized flow of a mud drill fluid in said hollow drill rod at a predetermined flow rate, an outer casing positioned about said drill rod and spaced therefrom to define a mud circulation annulus between said drill rod and outer casing, said drill fluid being convected to said drilling head by passage of said mud through said channels in said annular drilling head and out through said circulation annulus when said drill rod is rotated whereby said mud flow is away from said coring bit avoiding contact with the granular till projecting into said annular drilling head so as not to disturb the granular till core, said mud having a viscosity of at least 70 seconds as measured with a Marsh funnel, said mud in said drilling head being pressurized to about 140 to 175 KPa, a retractable soil sample receiving tube for insertion and retraction from said coring bit and dimensioned for receiving in close fit therein an undisturbed sample of said granular till soil and capable of retracting said sample from said hollow drill rod in an undisturbed form, and an outer soil stabilizing tube positioned about said outer casing and extending in a top portion of said soil whereby to prevent wash away about a bore drilled by said boring apparatus.

2. An apparatus as claimed in claim 1 wherein said coring bit is a cylindrical casing, said crown shaped drilling head being formed on a free end of said casing and defined by an inner abrading ring having a convexly curved outer abrading surface and an outer rearward circumferential tapered abrading surface, said fluid convection channels extending from said abrading surfaces to an inside wall of said cylindrical casing.

3. An apparatus as claimed in claim 2 wherein said fluid convection channels extend from an area intermediate said curved outer abrading surface and tapered abrading surface to lubricate said surfaces and to convect fine particles in the path of said drilling head.

4. An apparatus as claimed in claim 3 wherein said cylindrical casing is provided with an inner thread portion adjacent a connecting end thereof to receive said drill rod working end in threaded engagement therein.

5. An apparatus as claimed in claim 3 wherein there are eight fluid convection channels equidistantly spaced about said crown shaped drilling head, said outer abrading surfaces being provided with industrial diamonds having a size of about 60 to 90 stones per carat.

6. An apparatus as claimed in claim 1 wherein said mud drill fluid is a bentonite mud of high viscosity whereby not to wash away silt and sand particles of said soil.

7. An apparatus as claimed in claim 1 wherein said soil sample receiving means is a triple tube wire line core barrel having an open bottom end and a connecting top end, means to secure said top end to a retracting cable, said top end having evacuating ports to provide for the evacuation of mud fluid from within said cylindrical tube when said tube is inserted downwardly in said hollow drill rod.

8. An apparatus as claimed in claim 7 wherein said means to secure said top end to a retracting cable comprises a connecting element coupled to said top end and having an engageable knob at a top end thereof, said cable having a gripping jaw at a lower end for automatic engagement with said knob.

9. An apparatus as claimed in claim 1 wherein said coring bit has an inner diameter of about 80–85 mm, said speed of rotation of said drill rod being about 150–200 rpm with said mud drill fluid having a flow rate of about 18 to 23 liters/min.

10. A boring apparatus to obtain continuous undisturbed sampling from heterogeneous non-cohesive granular till soils, said apparatus comprising a hollow drill rod having a coring bit of preselected diameter secured at a boring end thereof, drive means for rotating said drill rod at a predetermined speed and down pressure dependent on the coring bit diameter to impart rotation to said coring bit for the penetration of said drill rod in said soil at a predetermined rate, said coring bit having an annular drilling head, a plurality of fluid convection channels of preselected diameter in said annular drilling head, convection means to provide for a pressurized flow of a mud drill fluid in said hollow drill rod at a predetermined flow rate, an outer casing positioned about said drill rod and spaced therefrom to define a mud circulation annulus between said drill rod and outer casing, said drill fluid being convected to said drilling head by passage of said mud through said channels in said annular drilling head and out through said circulation annulus when said drill rod is rotated whereby said mud flow is away from said coring bit avoiding contact with the granular till projecting into said annular drilling head so as not to disturb the granular till core, said mud having a viscosity of at least 70 seconds as measured with a Marsh funnel, said mud in said drilling head being pressurized to about 140 to 175 KPa, a retractable soil sample receiving tube for insertion and retraction from said coring bit and dimensioned for receiving in close fit therein an undisturbed sample of said granular till soil and capable of retracting said sample from said hollow drill rod in an undisturbed form, means to advance said outer casing in said soil behind said drill rod and coring bit, a mud drill fluid reservoir being provided about an outer circumferential edge of said outer casing and said drill rod, means to remove soil particles from said mud and for convection of said mud into said hollow drill rod, a centrifugal pump being associated with said reservoir to filter fine particles of soil from said mud fluid.

11. An apparatus as claimed in claim 10 wherein said means to advance said outer casing is said drive means for rotating said drill rod.

12. A method of extracting a continuous undisturbed sampling from a heterogeneous non-cohesive granular till soil comprising the steps of:

(i) boring, at a predetermined speed and down pressure dependent on a preselected coring bit diameter, an annular cavity in a soil to be sampled by means of a hollow drill rod having said coring bit with a crown annular drilling head at a boring end of said tube;

(ii) simultaneously injecting, at a predetermined flow rate, a mud drill fluid having a viscosity of at least 70 seconds as measured with a Marsh funnel in a plurality of convection channels in said annular drilling head to flow over said crown shaped drilling head;

(iii) convecting said drill fluid past said drilling head;

(iv) convecting said mud from said convection channels exteriorly of said coring bit in a circulation annulus formed between said drill rod and an outer casing positioned about said drill rod and spaced therefrom so that said mud does not contact the granular till projecting into said annular drilling head so as not to disturb the granular till core;

(v) simultaneously advancing a soil sample receiving tube suspended in said coring bit and at a predetermined rate for receiving in close fit therein an undisturbed granular till soil sample excavated by said drilling head; and (vi) retracting said sample receiving tube from said hollow drill rod without disturbing said sample.

13. A method as claimed in claim 12 wherein said step (ii) comprises injecting said mud drill fluid over said drilling head under a pressure of about 140 to 175 KPa.

14. A method as claimed in claim 12 wherein said step (vi) comprises simultaneously injecting said mud drill fluid under pressure in said circulation annulus formed between said drill rod and an outer casing spaced thereabout to cause said mud to rise in said hollow drill rod without disturbing said sample, and retracting said core barrel at the same rate as said speed of displacement of said mud in said hollow drill rod.

15. A method as claimed in claim 13 or 14 wherein there is further provided the step of filtering fine particles from said mud drill fluid by means of said pressure pump, said pump being a centrifugal pump.

16. A method as claimed in claim 14 wherein said mud drill fluid is injected at a pressure of about 140 to 175 KPa.

17. A method as claimed in claim 14 wherein said step (i) comprises rotating said drill rod and said outer casing, alternately.

* * * * *